US006075507A

United States Patent [19]

Miyahara et al.

[11] Patent Number: 6,075,507

[45] Date of Patent: Jun. 13, 2000

[54] ACTIVE-MATRIX DISPLAY SYSTEM WITH LESS SIGNAL LINE DRIVE CIRCUITS

[75] Inventors: Tae Miyahara; Shigeki Okutani; Hiroshi Hada; Susumu Ohi, all of Tokyo, Japan

[73] Assignee: NEC Corporation, Tokyo, Japan

[21] Appl. No.: 08/986,354

[22] Filed: Dec. 8, 1997

[30] Foreign Application Priority Data

Dec. 9, 1996 [JP] Japan ..... 8-328532

[51] Int. Cl.[7] ..... G09G 3/36; G09G 5/10

[52] U.S. Cl. ..... 345/89; 345/87; 345/95; 345/147; 345/100

[58] Field of Search ..... 345/90, 92, 205, 345/206, 211, 89, 94, 95, 96, 98, 100, 87, 147

[56] References Cited

U.S. PATENT DOCUMENTS

| | | | |
|---|---|---|---|
| 5,250,937 | 10/1993 | Kikuo et al. | 345/89 |
| 5,614,923 | 3/1997 | Gotou et al. | 345/98 |
| 5,625,387 | 4/1997 | Moon | 345/89 |
| 5,877,737 | 3/1999 | Kim et al. | 345/211 |
| 5,912,655 | 6/1999 | Hoshimo et al. | 345/100 |

FOREIGN PATENT DOCUMENTS

| | | |
|---|---|---|
| 3-38689 | 2/1991 | Japan . |
| 5-265045 | 10/1993 | Japan . |
| 6-148680 | 5/1994 | Japan . |
| 8-248385 | 9/1996 | Japan . |
| 9-329809 | 12/1997 | Japan . |
| 10-142578 | 5/1998 | Japan . |

*Primary Examiner*—Richard A. Hjerpe
*Assistant Examiner*—Benjamin D. Bowers
*Attorney, Agent, or Firm*—Sughrue, Mion, Zinn, Macpeak & Seas, PLLC

[57] ABSTRACT

An active matrix liquid display system where two scanning lines are successively selected within one horizontal scanning period, by which display voltages are written on pixels lined up in a horizontal direction, and the voltage supplied to a signal line when an even number display pixel is selected and the voltage supplied to a signal line when an odd number display pixel is selected are switched according to a gradation voltage generated from a gradation power source. Accordingly, when there is implemented a dot inversion drive in the active matrix liquid display system where there are less number of signal line drive circuits, and when a former stage pixel is subjected to modulation due to interpixel parasitic capacitance, it is possible to equalize an electric voltage of the former stage pixel being modulated as a latter stage pixel is being written with an electric voltage of the latter stage pixel, owing to revision of a gradation voltage of the former stage pixel.

16 Claims, 7 Drawing Sheets

PREIOR ART

FIG. 2 PRIOR ART

SIGNAL LINE DRIVE CIRCUIT SIDE

SCANNING LINE DRIVE CIRCUIT SIDE

| | | | | | | | | | | | |
|---|---|---|---|---|---|---|---|---|---|---|---|
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |

$$V_{pp}(n) = \frac{C_{pp}}{C_{tot}} \Delta V_D$$

ACTIVE-MATRIX DISPLAY SYSTEM WITH LESS SIGNAL LINE DRIVE CIRCUITS

BACKGROUND OF THE INVENTION

The present invention relates to a matrix display system having less signal line drive circuits.

DESCRIPTION OF THE RELATED ART

Conventionally, an active matrix liquid crystal display system is constituted with thin film transistors (TFTs). In the active matrix liquid display system of the first conventional example, there is applied a method in which all display pixels of horizontal display lines drive at the same time. This drive method is also referred as a normal drive. In this particular conventional example, there are provided a transistor and a display pixel as one set for each intersection of a signal line and a scanning line. Thus, a row of display pixels corresponds to one signal line, which means that one signal line driver is necessary for one row of display pixels.

In recent years, the active matrix liquid display systems using thin film transistors (TFTs) are mainly applied to personal computers and so forth. In order to utilize this system in a wider range of the related field, it becomes one of the important issues how you can provide the products using the system for lower prices. As to one way of fulfilling this condition, there is a cut-down on the production cost. With connection to this proposal, the focus has been set on reducing the number of output drivers of the signal line data, which takes up a large portion of the production cost. The output driver of the signal line data is considerably expensive for it deals with a wide frequency band of an image signal and such and operates in a high-speed data rate. Accordingly, there has been proposed a drive method for reducing the production cost by cutting the number of output drivers for the signal line data by half.

As to more concrete methods for the drive method mentioned above, there are the ones disclosed in the Japanese Patent Laid-Open Publication Numbers 3-38689, 5-265045 and 6-148680. The conventional technology being set forth in these official gazettes will be referred as the second conventional example. In the second conventional example, two rows of display pixels are connected to one signal line, and thus two rows of display pixels can be driven with one signal line. Therefore, the number of output drivers of the signal line data can be reduced by half.

FIG. 1 is a diagram showing a circuit structure of the TFT substrate of the second conventional example. In this conventional active matrix substrate, a display pixel of an odd number and a display pixel of an even number, both of which are aligned in the horizontal direction, are connected to the same signal line through different thin film transistors each of which having a gate terminal connected to a different scanning line. In this structure, a display voltage is written on the pixels being lined up in the horizontal direction by successively selecting two scanning lines within one horizontal scanning period. Under the condition where a select signal from a scanning line drive circuit successively shifts from a scanning line G1 to G2, from G2 to G3, from G3 to G4 . . . , each data is to be written on a display pixel d11, d12, d22, d21 . . . when focusing on a signal line S1, likewise, each data is to be written on a display pixel d14, d13, d23, d24 . . . when focusing on a signal line S2.

According to the above mentioned writing procedure, data are written two times within one writing period as the odd number data and then as the even number data. Consequently, as compared with the normal drive method in which all the display pixels on the horizontal display lines are being written at the same time, the writing period is reduced to half a period.

FIG. 2 is a model diagram showing the polarities of the voltages being maintained in the display pixels of the liquid crystal panel. The signal line drive circuit is capable of acquiring a display image without a horizontal cross talk by having neighboring outputs output voltages of different polarities through which modulation toward a counter electrode is being restrained. Moreover, as the polarity of each output inverts at every writing of one horizontal pixel row, the final voltage polarities of writing pixels would become of a dot inversion state between two adjacent pixels having different polarities.

As being described above, however, when driving the active matrix liquid crystal display system with less line signal drive circuits, data is to be written on the display pixels while having one signal line in between, in the order indicated by the arrows shown in FIG. 3. Here, there is provided a parasitic capacitance (Cpp) in between every two adjacent pixels. With regard to two adjacent pixels having one signal line in between, due to this parasitic capacitance, a pixel electric potential being written first is subjected to being modulated at the time when the other pixel electric potential is written, the other pixel electric potential having the polarity opposite to that of the one being written first. This modulation of electric potential of the former stage pixel is caused by the latter stage pixel having the electric potential with the opposite polarity. Consequently, as it is shown in FIG. 2, the pixel electric potentials of a former stage pixel and a latter stage pixel are different from each other by Vpp. This difference between the former stage pixel and the latter stage pixel is to be recognized as a difference in luminance. Therefore, it has been noted as a problem that when displaying the green pixel checkers, i.e. a pattern where only the pixels being hatched are to be illuminated, vertical rows with only former stage pixels and vertical rows with only latter stage pixels appear in pairs respectively, which are recognized as vertical strip blurs.

SUMMARY OF THE INVENTION

It is therefore the object of the present invention to provide an active matrix liquid crystal display system capable of producing superior display quality even under the condition where some special pattern is displayed by the dot inversion drive.

In order to fulfill the above objective, there is provided an active matrix liquid display system comprising: a liquid display panel having more than two signal lines for supplying signals to be applied to electrodes of display pixels being arranged in matrix form, more than two scanning lines for controlling writing on the display pixel, an active matrix substrate where switching elements are formed to implement writing operation, and a counter substrate at the counter surface where common electrodes are formed having a liquid layer placed in between itself and the active matrix substrate; a signal line drive circuit connected to more than two signal lines; a scanning line drive circuit connected to more than two scanning lines; a data processing circuit supplying data to signal line drive circuit; a timing generator circuit generating timing signals for operations of the signal line drive circuit the scanning line drive circuit and the data processing circuit; and a gradation power source section for generating gradation voltages for switching between the voltage provided to the signal line when an even number (or an odd number) pixel is selected, and the voltage provided to the signal line when an odd number (or an even number) pixel is selected, the active matrix substrate having odd number (or even number) display pixels arranged in the horizontal direction connected to the scanning lines, even number (or odd number) display pixels arranged in the horizontal direction connected to the signal lines, two scanning lines stretched in the horizontal direction provided to a voluntary display line in the horizontal direction, two pixels horizontally adjacent to each other with the signal line positioned in between the two having one gate electrode connected to an odd number (or an even number) scanning line and the other gate electrode connected to an even number (or an odd number) scanning line, two pixels vertically adjacent to each other with the scanning lines positioned in between the two having one gate electrode connected to an odd number (or an even number) scanning line and the other gate electrode connected to an even number (or an odd number) scanning line, successively selecting the two scanning lines within one horizontal scanning period to write display voltages on the pixels lined up in the horizontal direction, switching the gradation voltages.

Moreover, it is preferable that the above gradation power source section is constructed with a resistance ladder circuit, and that the switching of the gradation voltages are conducted by switching the gradation voltage of 0 gradation being the voltage at both ends of the resistance ladder at a cycle of half a horizontal period.

Furthermore, it is preferable that the switching elements are thin film transistors, and that the active matrix substrate is constructed by having the switching elements having their gate electrodes connected to scanning lines, through which two adjacent pixels having a signal line in between them are commonly connected to the same signal line.

The above and further objects and the novel feature of the invention will more fully appear from the following detailed description when the same is read in connection with the accompanying drawings. It is to be expressly understood, however, that the drawings are for illustration only and are not intended as a definition of the limits of the invention.

BRIEF DESCRIPTION OF THE DRAWINGS

FIG. 2 is a diagram illustrating the polarity condition, i.e. a dot inversion state of the conventional liquid display panel;

DESCRIPTION OF THE PREFERRED EMBODIMENTS

Figure 1:
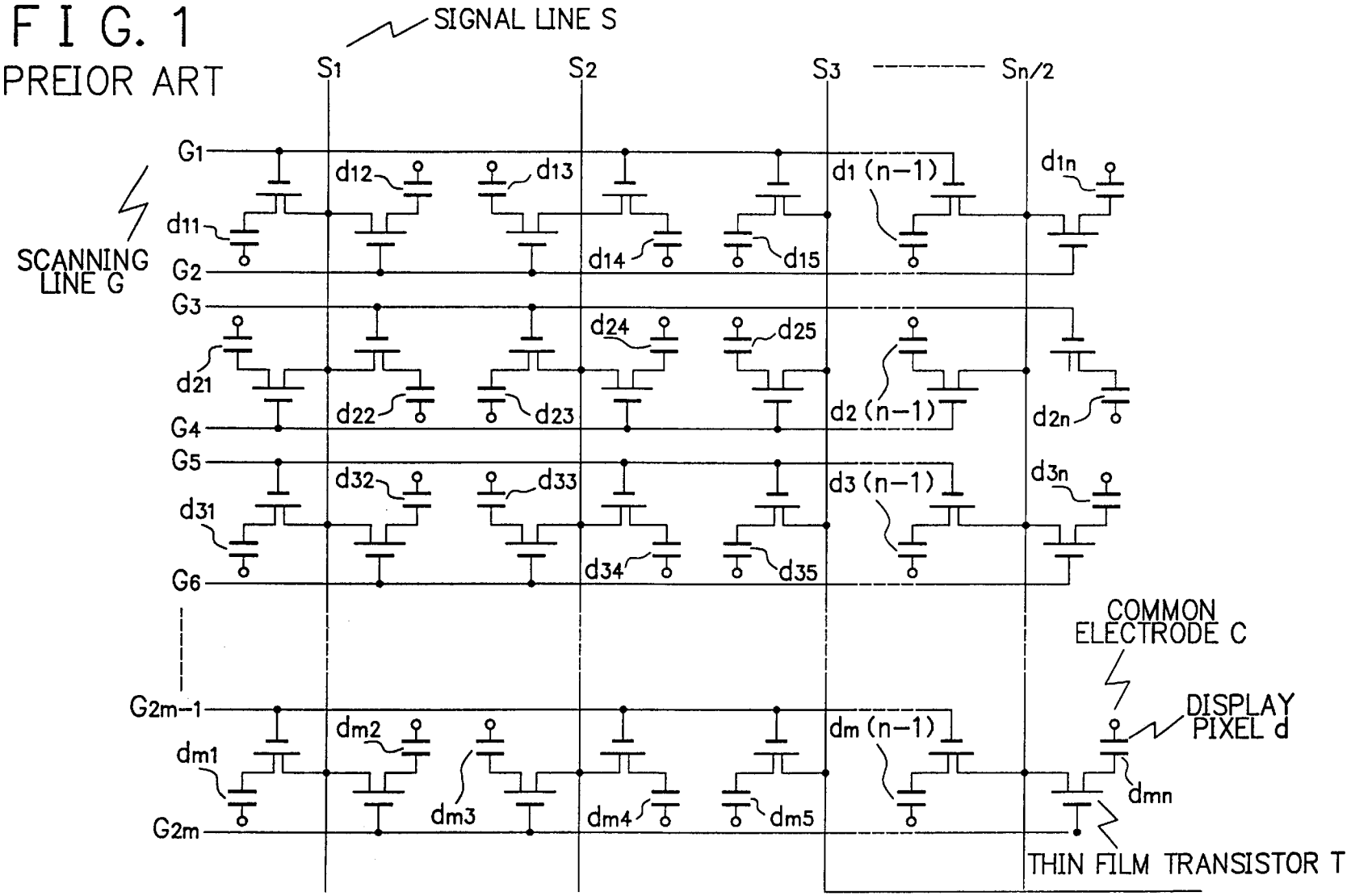
FIG. 1 is a circuit diagram showing the structure of the conventional liquid display panel.

Referring now to the drawings, a description of a preferred embodiment of the active matrix liquid crystal display system of the present invention will be given in detail.

Figure 3:
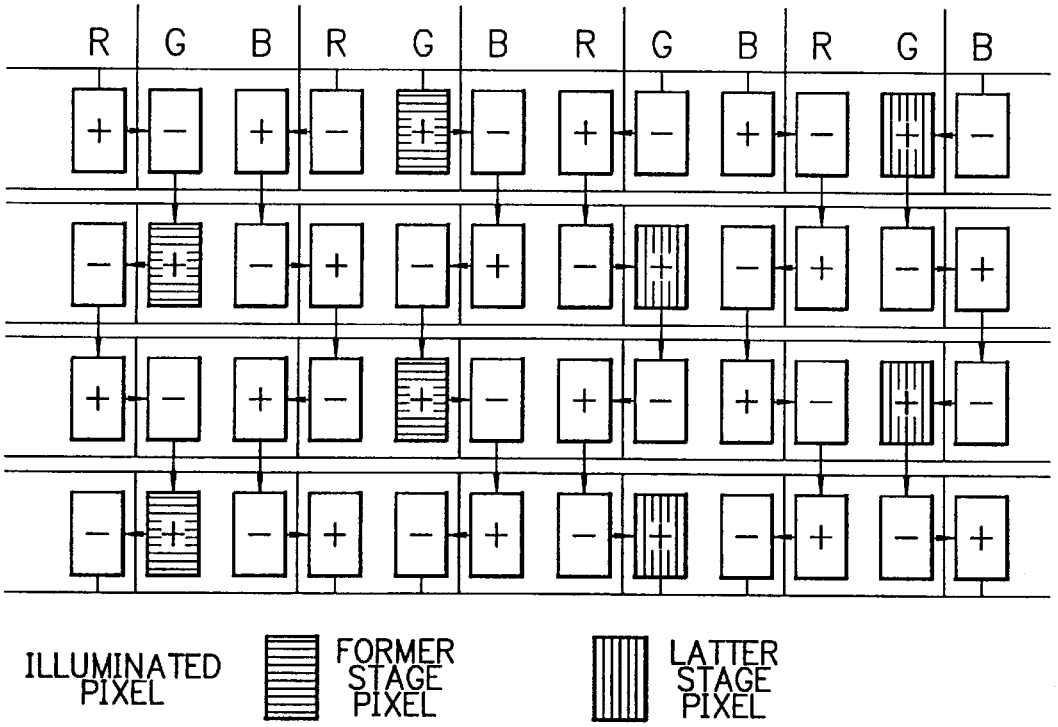
FIG. 3 PRIOR ART
FIG. 3 is a diagram showing a structural example of a green pixel checker pattern of the display screen.

One embodiment of the active matrix liquid crystal display system of the present invention is illustrated with reference to FIGS. 4 to 7. In the following description, FIGS. 1 to 3 used in the description of the conventional art are also referred to.

Figure 4:
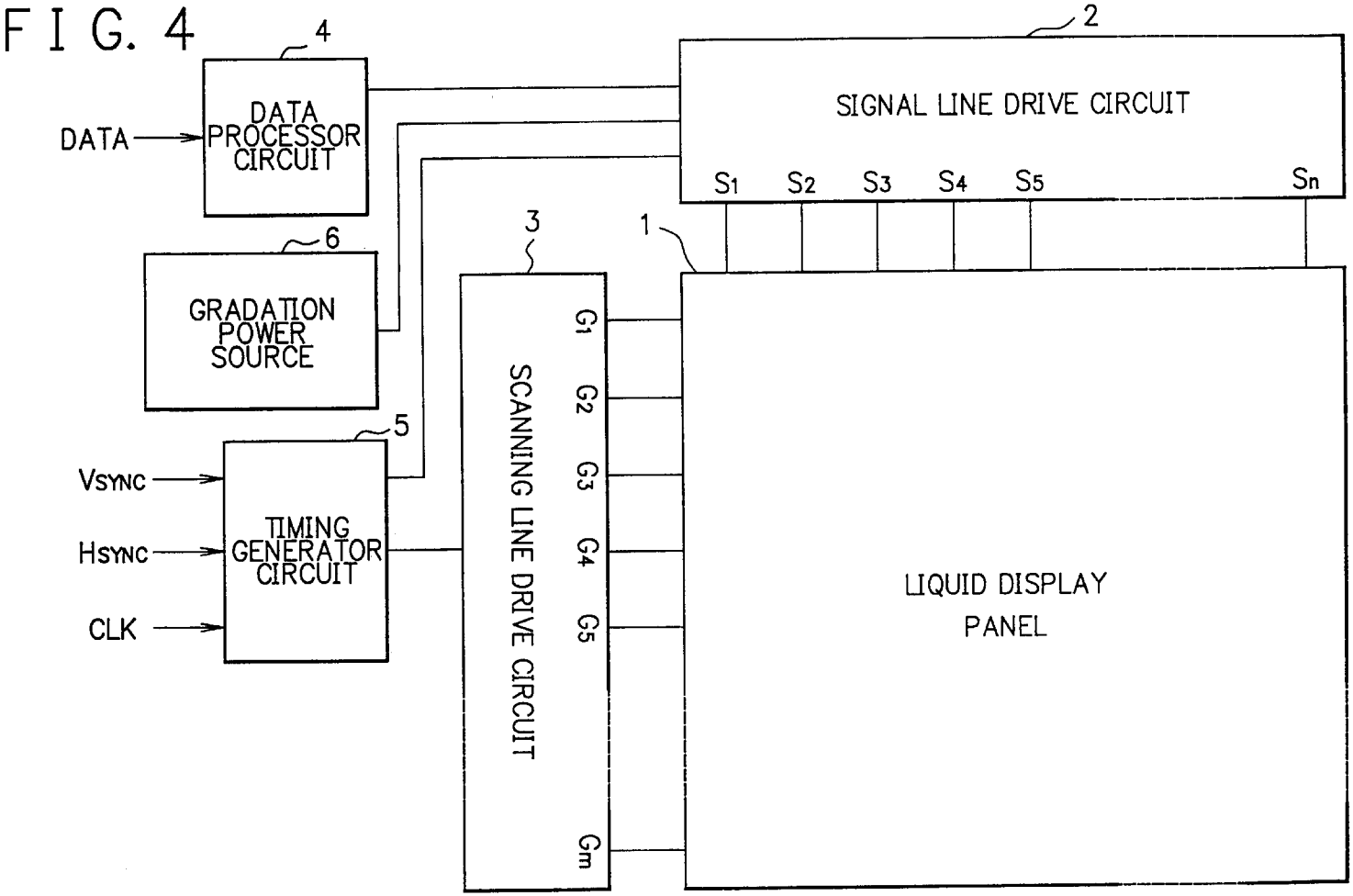
FIG. 4 is a structural block circuit diagram showing the embodiment of the active matrix liquid display system of the present invention.

FIG. 4 is a structural block diagram of an active matrix liquid display system as a whole. The active matrix liquid display system of the present embodiment comprises a liquid display panel 1 for displaying the images, a signal line drive circuit 2 and a scanning line drive circuit 3 both for driving the liquid display panel 1, a timing generator circuit 5 for driving both the signal line drive circuit 2 and the scanning line drive circuit 3, a data processor circuit 4 for rearranging data from the signal line drive circuit 2 so that it would fit to the circuit structure of the liquid display panel, and a gradation power source 6 for deciding a reference gradation voltage to become the standard for the gradation voltage which is eventually determined.

The active matrix liquid display system having the above structure adopts the liquid display panel illustrated in FIG. 1. This liquid display panel is constructed with a plurality of pixel electrodes of which total number is given by n rows×m lines. To a horizontal display line, there is provided a pair of scanning lines in the following manner, G1 and G2, G3 and G4, and so on. One of the two adjacent display pixels having a signal line S between the other has a gate electrode connected to the odd number scanning line, e.g. G1, G3, . . . G2m−1, and the other has its gate electrode connected to the even number scanning line, e.g. G2, G4, . . . G2m. One of the two adjacent display pixels having scanning lines Gs between the other has a gate electrode connected to the odd number scanning line, e.g. G1, G3, . . . , and the other has its gate electrode connected to the even number scanning line, e.g. G2. G4, . . .

Figure 5:
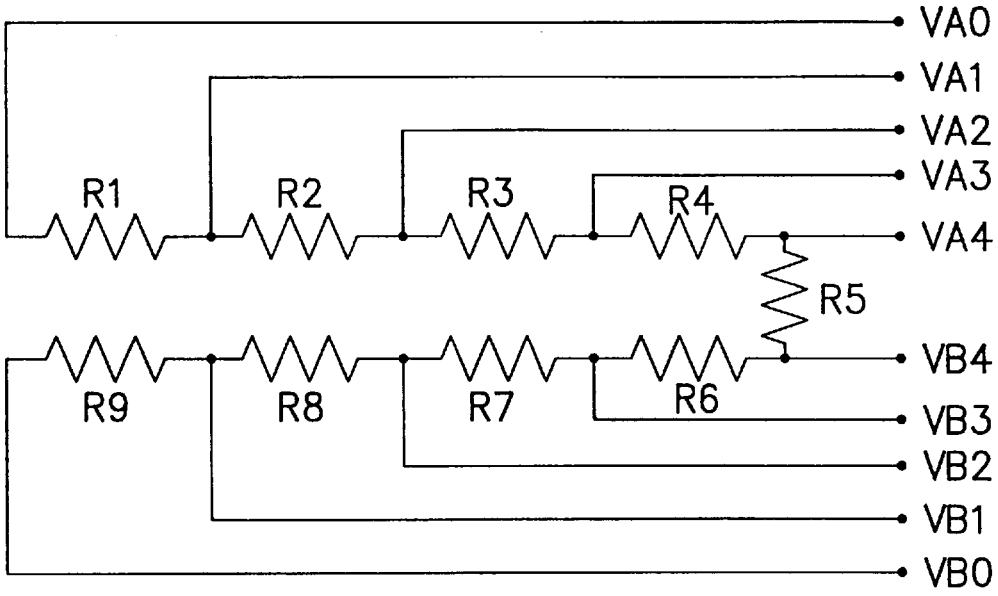
FIG. 5 is a circuit diagram showing a voltage setting circuit of a gradation power source section.
Figure 6:
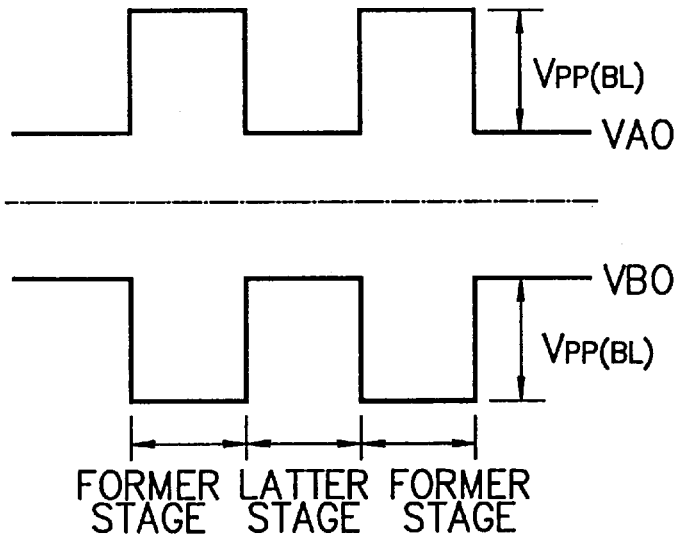
FIG. 6 is a diagram illustrating the relation between a former stage pixel and a latter stage pixel in terms of a pixel electric potential, after switching of gradation voltages.
Figure 7:
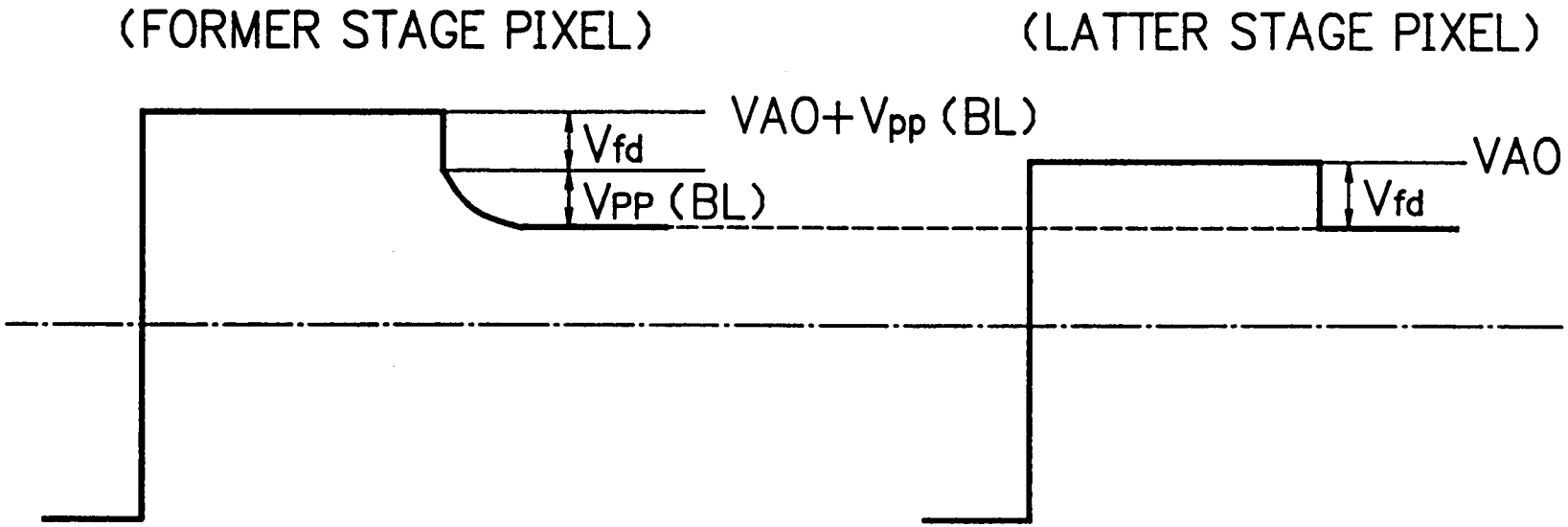
FIG. 7 is a conceptual diagram illustrating the operation state of data after switching of gradation voltages.

The gradation power source 6 shown in FIG. 4 is a section generating gradation voltages for switching corresponding to each occasion, between the voltage being supplied to the signal line S when an even number pixel is being selected and the voltage being supplied to the signal line S when an odd number pixel is being selected. FIG. 5 shows an example of a circuit structure of this gradation power source 6 illustrated as having a structure of a resistance ladder circuit.

According to FIG. 5, the gradation power source 6 of the present embodiment has the gradation voltages divided up into positive side voltages VA0 to VA4, and negative side voltages VB0 to VB4, due to resistances R1 to R9. The resistors R1 to R9 are intended for designating the gradation voltages, where voltages VA0 to VA4 set by resistors R1 to R4 are gradation voltages of a positive frame and voltages VB0 to VB4 set by resistors R6 to R9 are gradation voltages of a negative frame.

As an illustration, a drive operation of the above mentioned liquid display panel as being applied within the active matrix liquid display system of the present embodiment will be described.

As in the conventional case, first a data inputted in serial is catched by the data processing circuit 4 where a line portion of it is stored in the line memory within the data processing circuit, after which odd number pixel data and even number pixel data are divided up into a former half of one horizontal period (½H), and a latter half of the same (½H), so as to be outputted to the signal line. Note that one horizontal period is defined as 1H. When the data is outputted to the signal line in such manner, the scanning lines Gs are to have the on-voltage of the TFTs shifted in turn from G1 to G2, G2 to G3 and so on, consequently letting a designated data to be written on a designated pixel. When focusing on the signal line S1, for example, as the scanning lines are turned on successively starting from G1, gates of switching elements d11, d12, d22, d21, . . . are opened in turn in a corresponding order. Likewise, when focusing on signal line S2 under the same condition, gates of switching elements d14, d13, d23, d24, . . . are opened in turn in a corresponding order. Thus, data from the signal lines S1 and S2 are written on the pixels.

Figure 8:
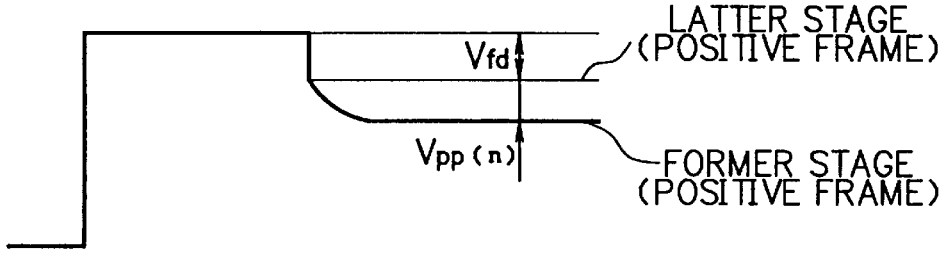
FIG. 8 is a diagram comparing pixel electric potentials of the conventional former stage pixel and the latter stage pixel of a positive frame.

Considering the polarities of signals outputted from the signal line drive circuit, those signals being outputted from one of the two adjacent outputs have polarities opposite to those outputted from the other, and they are subjected to polarity inversion at every single output. Under the circumstances, the polarity condition of the screen after the end of writing of one frame becomes a dot inversion state as shown in FIG. 2. Here, as there is provided a parasitic capacitance in between two adjacent pixels, with regard to two pixels having one signal line in between, the electric potential of the former stage pixel is subjected to a modulation of Vpp(n) at n gradation at the time when the electric potential of the latter stage pixel is written, which is obvious from FIG. 8. Vpp(n) is defined by the expression below where ΔVD is a difference between the positive side voltage and the negative side voltage of the gradation voltages at n gradation, Cpp is a parasitic capacitance provided in between any two adjacent pixels and Ctot is a total capacitance provided for one pixel.

$$Vpp(n)=\Delta VD\cdot(Cpp)/(Ctot) \quad (1)$$

Therefore, by revising the gradation voltage of the former stage pixel by the amount of a modulation voltage Vpp (n), it is possible to match the writing voltages of the former stage voltage with the latter stage voltage.

For instance, if the gradation power source 6 shown in FIG. 4 has the structure of a resistance ladder as the one being illustrated in FIG. 5, the gradation voltages are to be divided up into a positive side voltages VA0 to VA4, and a negative side voltages VB0 to VB4. At this point, the gradation voltage ΔVD at n gradation is defined by the expression below using VA0 and VB0 which are the voltages corresponding to 0 gradation.

$$\Delta VD=(VA0+VB0)\cdot(Rn)/(Rtot) \quad (2)$$

According to expression (1), the modulation voltage Vpp (n) at each gradation is proportional to the gradation voltage ΔVD. According to expression (2), the gradation voltage ΔVD is proportional to voltages VA0 and VB0. Therefore, by revising voltages VA0 and VB0 by the amount of a voltage Vpp(BL), it is possible to revise not only 0 gradation but also the half tone. In order to revise voltages VA0 and VB0, they should be altered by the amount of a voltage Vpp(BL) in a cycle half a horizontal period (½H), in a way shown in FIG. 6, instead of entering DC voltage.

Next, the driving method of the present invention will be described. The liquid display panel 1 is driven by the signal drive circuit 2 arranged horizontally, and the scanning line drive circuit 3 arranged vertically. The signal line drive circuit 2 is driven by an output timing control signal HSYNK of the signal line data and a data frequency control signal CLK, both of which generated by the timing generator circuit 5. Output terminals S1, S2, S3, S4, . . . are connected to the signal lines Ss of the liquid display panel 1. Here, the number of signal lines is half the number of the horizontally arranged pixels.

The scanning line drive circuit 3 is driven by an output timing control signal VSYNK of the scanning line data and a data frequency control signal CLK, both of which generated by the timing generator circuit 5. Outputs G1, G2, G3, G4, . . . are connected to the scanning lines Gs of the liquid display panel 1. The number of scanning lines is twice the number of the vertically arranged pixels. Select signals from the scanning line signal circuit 3 are outputted in turn from outputs G1, G2, G3, G4, . . . to the gate electrodes of the TFTs. Furthermore, data are divided up into an odd number data group and an even number data group, and then inputted into the signal line drive circuit 2 within half a horizontal scanning period (½·H). After that, basing on the reference gradation voltage provided by the gradation power source 6, the line drive circuit 2 outputs to the panel the gradation voltage being finally determined by resistance division within the signal line drive circuit 2.

According to the active matrix liquid display system described in the above embodiment, any two pixels adjacent to each other in the horizontal direction share one signal line, and the number of signal line drive circuits are reduced to half the number. Moreover, the gradation voltage of the former stage pixel is previously revised by the amount covering the modulation voltage (Vpp) which is the amount applied to the electric potential of the former stage pixel at the time of writing of electric potential on the latter stage pixel. As a result, even when the former stage pixel electric potential is modulated due to interpixel parasitic capacitance at the time of writing on the latter stage pixel, the electric potentials of the former stage pixel and the latter stage pixel become equal. Consequently, it is possible to acquire a superior display quality. This means that it is possible to obtain superior display quality even when the expensive driver ICs of the signal line drive circuit are reduced to half the number by arranging the signal lines to be shared among rows of pixels, and when some special patterns are generated by a dot inversion drive. Especially, it is notable that the display quality does not deteriorate even when some particular patterns such as green pixel checkers are represented.

As it is obvious from the above description, the active matrix liquid display system of the present invention switches between the voltage supplied to a signal line when an even number display pixel is selected and the voltage supplied to a signal line when an odd number display pixel is selected. Thus, it successively selects two scanning lines within one horizontal scanning period so as to write the display voltages on the pixels arranged in a horizontal line, and switches the gradation voltages. Accordingly, when there is implemented a dot inversion drive in the active matrix liquid display system where there are less number of signal line drive circuits, and when a former stage pixel is subjected to modulation due to interpixel parasitic capacitance, it is possible to equalize the electric voltage of the former stage pixel being modulated as a latter stage pixel is being written with the electric voltage of the latter stage pixel, owing to revision of a gradation voltage of the former stage pixel. Consequently, it is possible to obtain high picture quality with lower cost.

While the present invention has been described with reference to a particular illustrative embodiment, such description is for illustrative purposes only, and it should not serve as restriction to the invention. Therefore, it is to be understood that changes and variations may be made without departing from the spirit or the scope of the claims. For instance, the use of the expressions such as "odd number" and "even number" defining functions among particular system constituents such as pixels is one example, and thus it is also possible to have a structure where the functions of the "odd number" constituent and the "even number" constituent are reversed.

What is claimed is:

1. An active matrix liquid display system comprising:

a liquid display panel having a plurality of display pixels arranged in matrix form, a plurality of signal lines connected to the plurality of display pixels, a plurality of scanning lines for controlling writing on the plurality of display pixels, an active matrix substrate with a switching element for each of the plurality of display pixels, and a counter substrate at the counter surface where common electrodes are formed having a liquid layer placed between the counter substrate and the active matrix substrate;

a signal line drive circuit connected to the plurality of signal lines;

a scanning line drive circuit connected to the plurality of scanning lines;

a data processing circuit supplying data to the signal line drive circuit;

a timing generator circuit generating timing signals for the signal line drive circuit, the scanning line drive circuit and the data processing circuit; and a gradation power source section for generating gradation voltages for the plurality of signal lines, wherein the gradation power source section provides a pulsed positive side voltage and a pulsed negative side voltage connected to each other through a resistance ladder circuit to generate the gradation voltages, the pulsed positive side voltage and the pulsed negative side voltage being substantially 180 degrees out of phase with each other.

2. The active matrix liquid display system according to claim 1, wherein the gradation power source section alters the positive side voltage by a predetermined amount every half a horizontal scanning period.

3. The active matrix liquid display system according to claim 1, wherein the switching elements are thin film transistors.

4. The active matrix liquid display system according to claim 2, wherein the switching elements are thin film transistors.

5. The active matrix liquid display system according to claim 1, wherein two horizontally adjacent switching elements having a signal line between them are commonly connected to the signal line.

6. The active matrix liquid display system according to claim 2, wherein two horizontally adjacent switching elements having a signal line between them are commonly connected to the signal line.

7. The active matrix liquid display system according to claim 1, wherein each switching element further includes a gate electrode.

8. The active matrix liquid display system according to claim 7, wherein two horizontally adjacent switching elements having a signal line between them are positioned between an odd numbered scanning line and an even numbered scanning line, whereby the gate electrode of one switching element is connected to the odd numbered scanning line and gate electrode of the other switching element is connected to the even numbered scanning line.

9. The active matrix liquid display system according to claim 7, wherein an odd numbered scanning line and an even numbered scanning line are positioned between two vertically adjacent switching elements, whereby the gate electrode of one switching element is connected to the odd numbered scanning line and gate electrode of the other switching element is connected to the even numbered scanning line.

10. The active matrix liquid display system according to claim 1, wherein the timing generator circuit receives a frequency control signal and a horizontal output timing control signal to drive the signal line drive circuit.

11. The active matrix liquid display system according to claim 1, wherein the timing generator circuit receives a frequency control signal and a vertical output timing control signal to drive the scanning line drive circuit.

12. The active matrix liquid display system according to claim 1, wherein the gradation power source section alters the negative side voltage by a predetermined voltage every half a horizontal scanning period.

13. The active matrix liquid display system according to claim 1, wherein the modulation voltage between adjacent display pixels is about equal to the predetermined voltage by which the positive side voltage is altered.

14. The active matrix liquid display system according to claim 12, wherein the modulation voltage between adjacent display pixels is about equal to the predetermined amount by which the negative side voltage is altered.

15. A method for operating an active matrix liquid display system, wherein the active matrix liquid display system comprises a liquid display panel having a plurality of display pixels arranged in matrix form, a plurality of signal lines connected to the plurality of display pixels, a plurality of scanning lines for controlling writing on the plurality of display pixels, an active matrix substrate with a switching element for each of the plurality of display pixels, and a gradation power source section for supplying gradation voltage, the method including:

selecting a horizontal display line;

generating a first gradation voltage using a pulsed positive voltage and a pulsed negative voltage connected to each other through a resistance ladder circuit, wherein the pulsed positive voltage and the pulsed negative voltage are generated by the gradation power source section and are substantially 180 degrees out of phase with each other;

selecting display pixels within the horizontal display line to apply the first gradation voltage thereto;

applying the first gradation voltage to the selected display pixels;

selecting one of the two scanning lines within the horizontal scanning period associated with the horizontal display line;

generating a second gradation voltage by altering the pulsed positive voltage and the pulsed negative voltage by a predetermined voltage;

applying the second gradation voltage to the selected display pixels; and selecting the second of the two scanning lines within the horizontal scanning period associated with the horizontal display line.

16. The method for operating an active matrix liquid display system, wherein the predetermined voltage is about equal to the modulation voltage between adjacent display pixels.

* * * * *